United States Patent [19]

Weller

[11] 4,220,324

[45] Sep. 2, 1980

[54] CIRCULAR STACK SHEET FEEDING DEVICE

[75] Inventor: Hans Weller, Fichtenberg-Langert, Fed. Rep. of Germany

[73] Assignee: Maschinenbau Oppenweiler GmbH, Oppenweiler, Fed. Rep. of Germany

[21] Appl. No.: 19,233

[22] Filed: Mar. 9, 1979

[30] Foreign Application Priority Data

Mar. 15, 1978 [DE] Fed. Rep. of Germany ..... 2811197

[51] Int. Cl.[2] ..... B05B 1/30; B05B 7/00

[52] U.S. Cl. ..... 271/151; 271/152

[58] Field of Search ..... 271/3.1, 30 R, 31, 37, 271/38, 126, 127, 148-156, 171, 185, 186, 212, 216, 225, 275

[56] References Cited

U.S. PATENT DOCUMENTS

| | | | |
|---|---|---|---|
| 1,411,520 | 4/1922 | Robertson | 271/151 UX |
| 2,133,727 | 10/1938 | Staude | 271/216 |
| 4,010,945 | 3/1977 | Kistner | 271/151 |
| 4,026,550 | 5/1977 | Klenk | 271/151 |

*Primary Examiner*—Robert W. Saifer

*Attorney, Agent, or Firm*—Wigman & Cohen

[57] ABSTRACT

The present invention relates to a circular stack sheet feeding device having a lower loading platform, which can be loaded with imbricated (arranged with regular overlapping edges) sheet stacks, having a transport and reversing mechanism, which transports the imbricated sheet stacks in a first transport direction to the underside of a reversing drum and with the aid of the reversing drum transports the sheets about the drum upwards in a second transport direction onto a removal platform, above which is guided an elastically yielding, taut conveyor belt which runs in the direction of delivery and runs between two rollers which are arranged on axes parallel to the reversing drum and are horizontally adjustable in the delivery direction of the delivery wheel. The underside of the roller lying closest to the reversing drum and the upper side of the other roller arranged in the area of the end of the removal platform opposite the diverting drum are adjusted to the same height. Individualization means remove the top sheet of the stack in a perpendicular direction from the transport direction of the conveyor belt. The conveyor belt is supported in the removal area between the two rollers by a rigid support divided into two sections which are pivotably mounted about an axis that lies in the axis of rotation of the second roller or is parallel thereto. At least one pivot mechanism engages and is capable of pivoting the rigid support about the first roller.

11 Claims, 5 Drawing Figures

CIRCULAR STACK SHEET FEEDING DEVICE

BACKGROUND OF THE INVENTION

In the circular stack sheet feeding device according to West German Pat. No. 2,521,849, the areas of the support which determine the position of the sheet stack define a single plane. As long as the sheet stack has its full thickness or height, it is thereby assured that the uppermost sheet of the stack will lie in the plane defined by the two rollers and thereby be reliably taken hold of by the individualization means because accordingly the support only contacts the imbricated end of the stack. Toward the end of the stack, however, the thickness decreases. Because in the sheet feeding device according to the cited patent, the support for the end with the decreasing stack thickness is automatically pivoted into a position assuming a corresponding lower inclination, the sheet stack comes into contact with the support-also in the area of its underside following the imbricated end - which results in a bend being formed across the upperside of the stack. This bend results in the respective top sheet no longer lying in the plane defined by the rollers. This result can lead to malfunctions at the stack end in the sheet feeding device, manufactured according to the cited patent, in the removal of the uppermost sheet by the individualization means.

SUMMARY OF THE INVENTION

The primary purpose of the present invention is to improve a circular stack sheet feeding device with the view in mind that the sheet of a stack end can also be freely taken hold of by the individualization means. This object is obtained, according to this invention, because the support is divided into two sections which are pivotable relative to each other about a fold axis which lies across the direction of transport of the conveyor belt guided thereover. These two sections are capable of being set in pivotable positions and the angle defined thereby is 180° or an upwardly open obtuse angle.

The division of the support into two such sections and the pivotability of these sections relative to each other enables the support to form not only the primarily even surface for the sheet stack necessary for normal stack thicknesses, but also an angled support surface in the area of the folding axis. With this type of support surface, as the thickness of the stack decreases toward the end of the stack, the forming of a bend or kink in the upper side of the stack is avoided because the support assures that the bend in the underside of the stack is at the transition to the imbricated end. The kink is formed automatically when the stack thickness is kept full in the area of the folding axis by the bend in its support surface. This result is achieved because one section holds the imbricated section and the other section holds the non-imbricated underside of the stack in the correct angular positions to each other. Accordingly, the respective top sheet of the end of the stack is forced to lie in the same plane as the respective top sheet of the sheet stack at full thickness.

In many cases it will be sufficient to arrange the folding axis beneath the individualization means, which may take the form of a suction wheel. If it must be taken into consideration that the transition point of the nonimbricated underside of the sheet stack to the imbricated end can clearly deviate from the position lying beneath the individualization means, then the folding axis would have to be provided with means to allow shifting in a horizontal direction across its longitudinal dimension. This shifting could be carried out, for example, by a telescopically extending embodiment of the two sections.

The adjustment of the sections of the support, which sections are pivotable relative to each other, is possible in various ways while the stack thickness is reduced at the end of the stack. One effective manner is to provide a motor drive for the adjustment device in order to be able to automatically perform the adjustment without interrupting operations. For example, one can arrange a pivot drive for the one section at the other section. Such a drive could connect the two sections in a pivotable manner with selectable pivotable positions with the aid of articulated fittings. One can also, however, connect the section of the support farthest removed from the reversing drum with the other section in a freely pivotable manner by means of the folding axis, said support being supported in the area of its free end. In this case, the folding axis can be associated with a height adjusting mechanism, whereby the angle which the two sections together define can be changed by a height adjustment of the folding axis. Thus, the end of the support facing the reversing drum is pushed upward, for example, with the aid of springs. One can also form the folding axis as the pivot axis of the support and provide it with a pivot mechanism with a drive in place of one or more springs. However, in this type of embodiment, it is advantageous to make a height adjustment of the folding axis to varying stack thicknesses.

Because the position of the uppermost sheet changes as the thickness of the stack decreases, in a preferred embodiment, a sensor is arranged above the removal platform. This sensor is capable of detecting a deviation of the top sheet from the correct level. The monitoring thus need not be performed by an operator. Preferably, this sensor is formed as a control switch with a feeler which controls the adjusting mechanism or mechanisms. The support can then be automatically brought from the fully extended position into the location and angular position corresponding to the decreased stack thickness.

BRIEF DESCRIPTION OF THE DRAWINGS

The invention is described below in greater detail with the aid of exemplary embodiments illustrated in the drawings. Shown in schematic and partial view are the following.

DETAILED DESCRIPTION OF THE PREFERRED EMBODIMENTS

Figure 1:
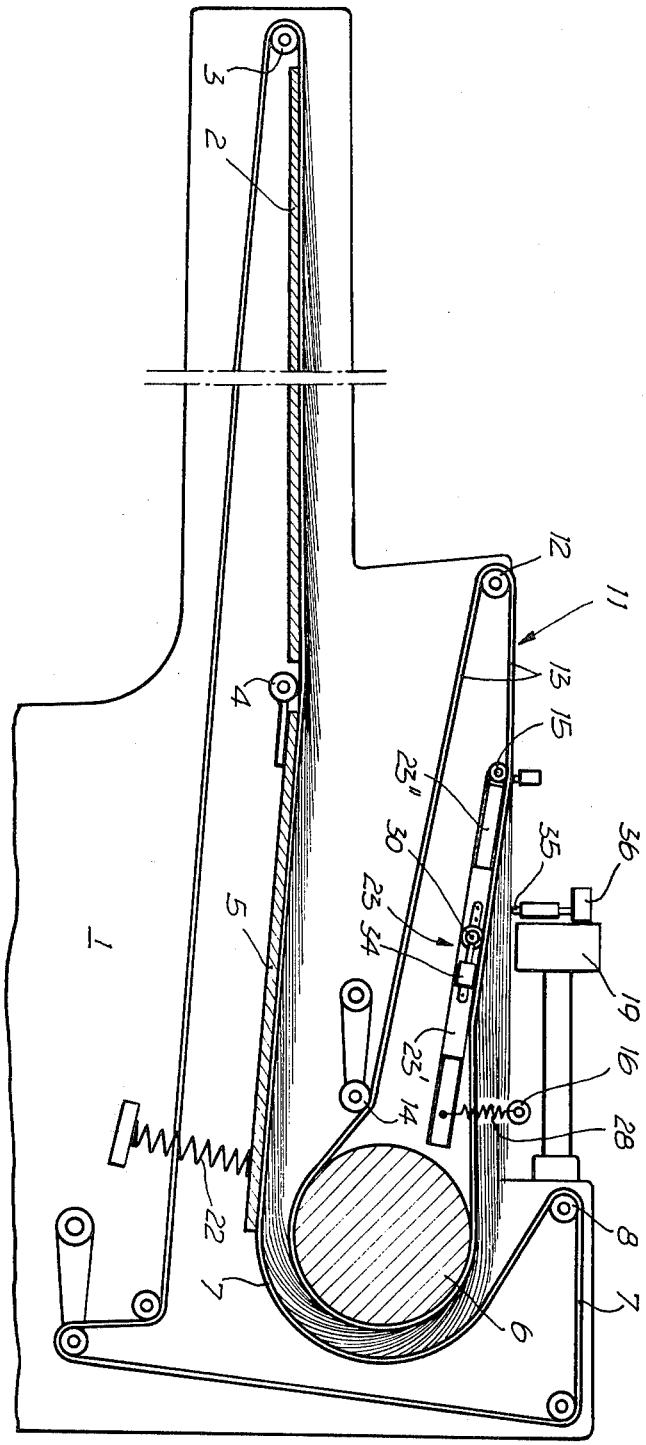
FIG. 1 is a side view of a first exemplary embodiment in a position of the support with a normal stack thickness.

A circular stack sheet feeding device, with the aid of which sheets can be individually led to a processing machine, particularly a folding machine, has a machine frame 1 which supports a loading platform 2 arranged above the machine frame 1. The free end of the loading platform 2 is located near a first diverting roller 3 and the opposite end is located near a second diverting roller 4. A rigid support plate 5 is attached to the diverting roller 4. The plate 5 ends below a reversing drum 6 rotatably mounted in the machine frame 1. On the opposite end of the plate 5, the second diverting roller 4 has an axis lying across the direction of delivery, which axis is pivotably mounted. In the exemplary embodiment, this pivot axis coincides with the axis of rotation of the diverting roller 4. Near to the end of the support plate 5, lying beneath the reversing drum 6, at least one biased pressure spring 22 engages on the underside thereof and is connected on the other end to the machine frame 1. The force of this pressure spring 22 is adjusted in such a manner that the support plate 5 remains in contact with a plurality of conveyor belts 7 which run for a distance spaced from each other over the first diverting roller 3, the loading platform 2, the second diverting roller 4 and the support plate 5, and then around the reversing drum 6 up to a third diverting roller 8 which is arranged at a distance above said reversing drum 6, form where the conveyor belts 7 return to the first diverting roller 3 by means of further diverting rollers (unnumbered), of which one acts as a tension roller and at least one other acts as a drive roller.

At a distance above the support plate 5 at a height which is adapted to the height of the transport path to the subsequent processing machine, a removal platform 11 is arranged, the free end of which is formed by a diverting roller 12 that lies above the edge zone of the loading platform 2 adjacent the second diverting roller 4. A plurality of adjacent conveyor belts 13 which are arranged at a distance spaced from each other are guided over the diverting roller 12 and run from the diverting roller 12 over a spring loaded tension roller 14 to the reversing drum 6. The conveyor belts 13 wrap partially around the reversing drum 6 and then run back to the diverting roller 12. These conveyor belts 13 form the contact surface for the removal platform 11. In addition, the removal platform 11 has two rollers 15 and 16 which are arranged in a displaced manner in the longitudinal direction of the conveyor belts 13. The axes of these two rollers 15 and 16 lie parallel to the axes of the diverting roller 12 and the reversing drum 6. The upper side of the roller 15 which lies close to the diverting roller 12, and the underside of the roller 16, which is arranged close to the reversing drum 6, lie in the plane in which the respective front sheet of the imbricated sheet stack transported from the loading platform 2 to the removal platform 11 by the conveyor belts 7 and 13 as well as by the reversing drum 6, is intended to lie. In the exemplary embodiment, as is common, this plane is a horizontal one.

The two rollers 15 and 16 are not only rotatable, but are also shiftable in a lateral direction relative to their longitudinal axis in the plane defined by them for the top sheet. In the exemplary embodiment, said shifting is necessarily in the same degree and in opposite directions. This is achieved by an adjusting transmission which is not shown.

At least in the region between the rollers 15 and 16, the end of the stack is supported by a support 23, embodied as a support plate, which forms a contact surface for all conveyor belts 13. The support 23 is divided transversally relative to the direction of movement of the conveyor belts 13 into two sections 23' and 23''. These two sections 23' and 23'' are pivotably connected with each other at a separation line by a folding axis 30 which lies across the direction of movement of the conveyor belts 13. The folding axis 30 is rotatably mounted in the section 23' in the exemplary embodiment and is rigidly connected with the other section 23'' by mounting elements 31. See FIG. 3. The one laterally extending end of the folding axis 30 is coupled with a self-locking miter transmission gear 32, which is capable of being selectively driven in one or the other direction by an electric motor 34 through a drive shaft 33. A rotation of the folding axis 30 results in a change of the angle, which the two sections 23' and 23'' define between themselves.

As shown in FIG. 1, the end of the section 23'' of the support 23 adjacent the roller 15 is pivotably mounted about an axis lying across the direction of movement of the conveyor belts 13. Thus in this exemplary embodiment, the support 23 is pivotably mounted about the axis of the roller 15. In addition, draw springs 28 engage the sides of the support 23. The other ends of the springs 28 are connected to the axis of the second roller 16. The force of the draw springs 28 is selected in such a manner that the section 23'' adjusts to an angle which results in the top sheet assuming a horizontal position in the plane determined by the rollers 15 and 16. Slightly horizontal plane is an individualization means in the form of a suction wheel 19 which takes hold of the top sheet and removes it across the direction of movement of the conveyor belts 13.

In this exemplary embodiment, the folding axis 30 lies beneath the suction wheel 19. It can, however, be brought into a position laterally displaced from this position if the shape of the sheet stack requires it, because both the section 23' and the section 23'' are formed so as to be telescopically extensible.

Figure 2:
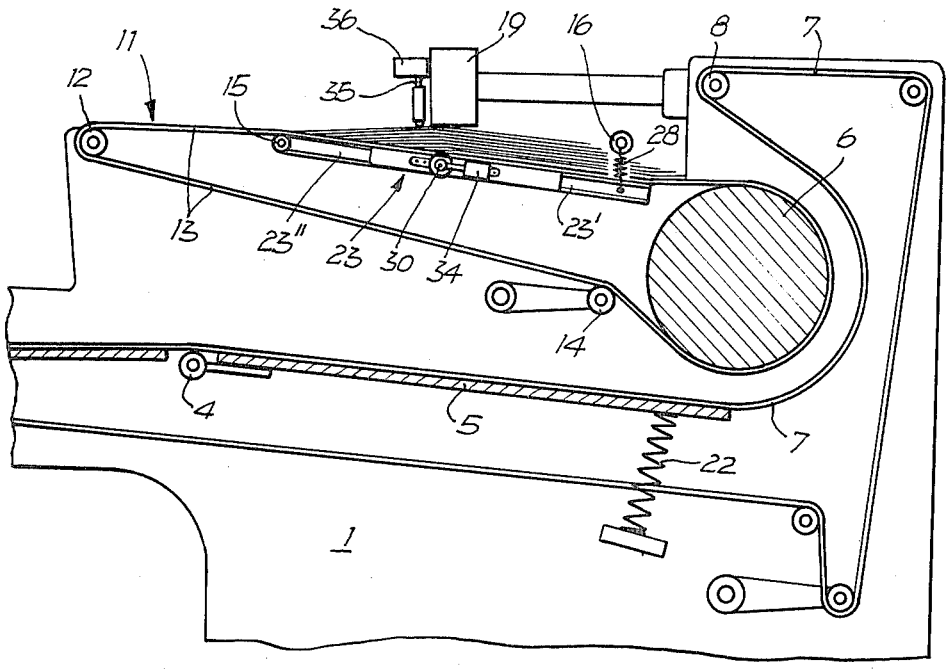
FIG. 2 is a side view of the exemplary embodiment according to FIG. 1 in a position of the support fully extended with a decreased stack thickness.

FIG. 1 shows the position of the support 23 with a full thickness or height of the sheet stack. Toward the end of the stack, however, the stack thickness decreases, as shown in FIG. 2. If one were to maintain an angle of 180° between the two sections 23' and 23'', as the stack thickness decreases, as shown in FIG. 2, this arrangement would result in a bend at the transition to the imbricated end of the cable on the underside thereof, which bend would increasingly disappear and, instead of a bend on the underside, a bend on the upperside of the stack would result. The top sheet would then no longer be found in the horizontal position which is necessary for a reliable removal by means of the suction wheel 19.

In order to prevent the upperside of the stack from being deformed in the above-described manner as a result of the decreasing stack thickness, the angle between the two sections 23' and 23'' is decreased to the necessary degree. The angle to be established is determined by the angle described by the imbricated end of the stack with the adjacent, non-imbricated underside of the stack. With the corresponding adjustment of the angle between the two sections 23' and 23'', as well as with the corresponding positioning of the bend of the support 23 of the transition at the non-imbricated underside of the stack to the imbricated end as the stack thickness decreases, the section of the stack adjacent the imbricated end is supported by the section 23' of the support 23 in the angular position which is correct with regard to the imbricated end, whereby the position of the top sheet of the stack remains unchanged with regard to the suction wheel 19, despite the decreased stack thickness.

Figure 3:
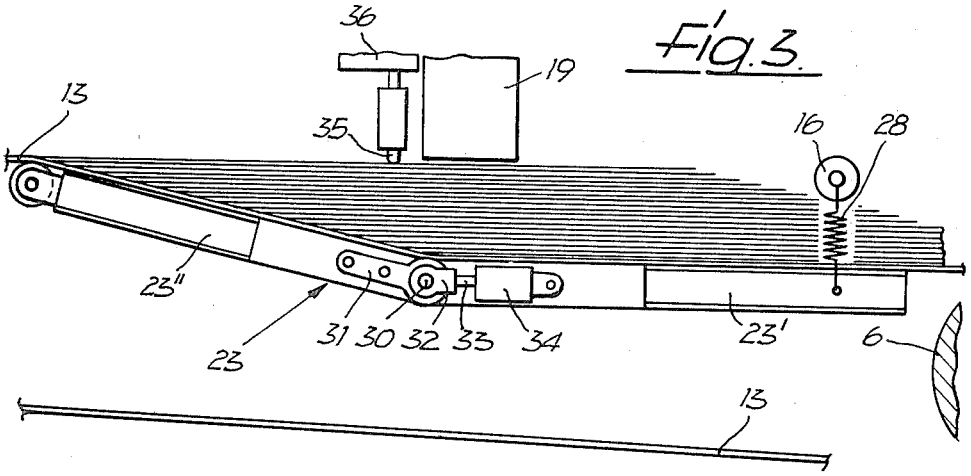
FIG. 3 is a side view of the first exemplary embodiment in a position of the two sections of the support defining an obtuse angle for an increased stack thickness.

In order to be able to automatically undertake the change of the angular position of the two sections 23' and 23'' relative to each other, a vertically shiftable feeling rod 35 is arranged adjacent the suction wheel 19, in such a manner as to cooperate with and activate a control switch 36 when the top sheet of the stack assumes a position which deviates upward from the predetermined horizontal poistion. The control switch 36 is thus only turned on when the bend shown in FIG. 2 begins to form on the top side of the stack. The control switch 36 then turns on the electric motor 34 which rotates in a direction which results in an upwardly open obtuse angle being formed between the sections 23' and 23'' of the support 23. As soon as the top sheet has again reached its correct horizontal position because of the forming of the bend in the support 23, the control switch 36 turns the electric motor 34 off. As shown in FIG. 3, the self-locking miter transmission gear 32 maintains the two sections 23' and 23'' in the achieved angular positon. The remaining sheets of the stack can then be removed by means of the suction wheel 19 without difficulty. Should a correction of the angle between the two sections 23' and 23'' be necessary again because of further decreasing stack thickness, this will also take place automatically with the aid of the feeling rod 35 and the control switch 36 as well as with the aid of the electric motor 34. The change of the angular position between the two sections 23' and 23'' has no influence on the function of the draw springs 28.

Figure 4:
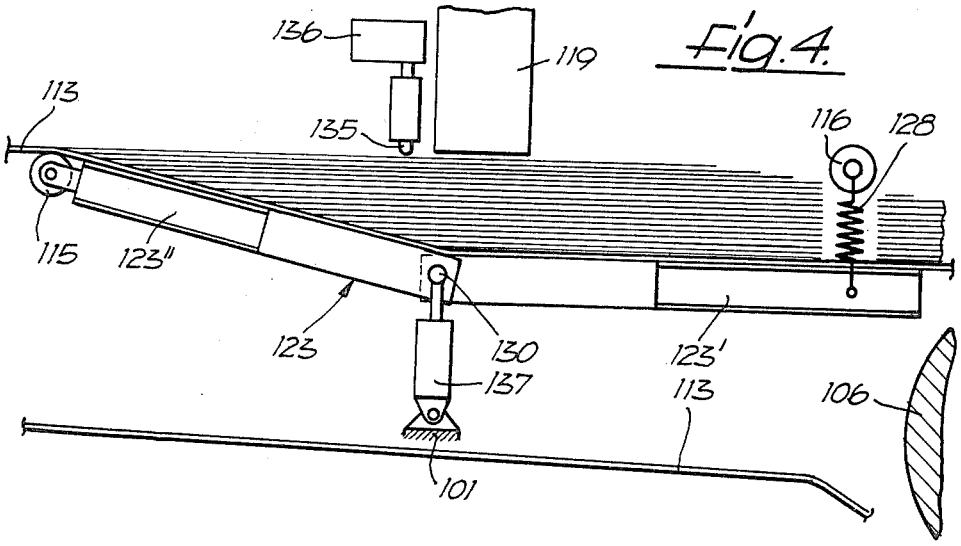
FIG. 4 is a side view of a second exemplary embodiment in a position of the two sections of the support defining an obtuse angle.

The second exemplary embodiment illustrated in FIG. 4 is distinguished from that according to FIGS. 1–3 only by a different embodiment of the support 123 which corresponds to the support 23 of the first exemplary embodiment. The remaining portions of the circular stack sheet feeding device are therefore not explained in detail. To that extent, the reader should refer to the statements regarding the first exemplary embodiment according to FIGS. 1–3.

The support 123 is divided, across the direction of movement of the conveyor belts 113 which are guided thereover, into two sections 123' and 123'', which sections are pivotably connected with each other at the line of separation by a folding axis 130. At both sides of the support 123, namely in this exemplary embodiment, at the ends of the folding axis 130, there is attached the upper end of a stroke device 137, whose other end is connected to the machine frame 101. These two identical stroke devices 137 are, in this exemplary embodiment, hydraulic cylinders. But other means, such as hoisting spindles driven by means of an electric motor, could also be used.

As in the first exemplary embodiment, draw springs 128 engage at the section 123 at the free end thereof near the reversing drum 106. In addition, the section 123'' is pivotably mounted on the axis of the roller 115 at its free end, in a manner similar to that of the section 23''. The axis of the roller 115 is adjustable in the horizontal direction by means of an adjusting drive (not shown) to the same degree as the roller 116, but in the opposite direction. This adjustment is possible as a result of the telescopically extensible embodiment of the two sections 123' and 123'' without a shifting of the folding axis 130. The telescopically extensible embodiment of the two sections of the support 123 also makes possible a shifting of the folding axis 130 in the horizontal direction. In case this type of shifting is necessary to adapt the support 123 to the bend in the underside of the stack at the transition to the imbricated end, it is practical to hinge the lower end of the hoisting devices 137 to a horizontally adjustable sled (unnumbered) or the like.

The hoisting devices 137 are controlled by a control switch 136, which is arranged at a distance above the top sheet that is to be taken hold of by the individualization means 119. The control switch 136 is activated by means of a feeler rod 135, which detects the position of the top sheet of the stack. The control switch 136 causes a lowering of the folding axis 130, when the top sheet lies above the horizontal plane in which it must be located for a smooth removal by the individualization means 119. Thus, it is assured that the two sections 123' and 123'' are brought into a position in which they define an upwardly open obtuse angle when the stack thickness decreases at the end of the stack. The control switch 136, however, causes a lifting of the folding axis 130 if the top sheet lies too low below the horizontal plane in which the top sheet must be located for smooth removal. Thus, the angle of inclination of section 123'' of the support 123 is automatically adapted with the aid of the control switch 136. The hoisting devices 137 are automatically adapted to the angle of inclination of the imbricated end of the stack with regard to the top side of the stack.

Figure 5:
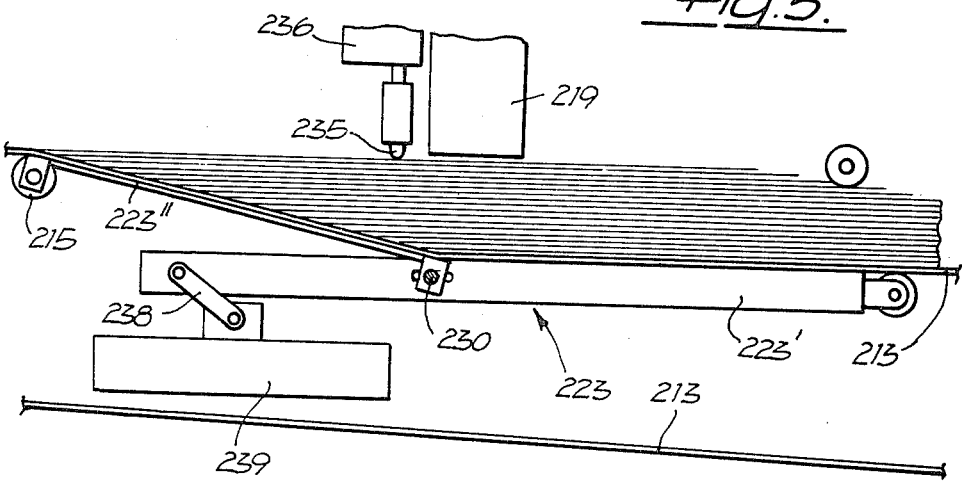
FIG. 5 is a side view of a third exemplary embodiment in a position of the two sections of the support defining an obtuse angle.

The third exemplary embodiment shown in FIG. 5 is also distinguished from the first exemplary embodiment according to FIGS. 1–3 only by a different embodiment of the support 123, so that with regard to the other characteristics of this circular stack sheet feeding device, the statements made with regard to the second exemplary embodiment according to FIG. 4 still hold.

The support 223 is divided into two sections 223' and 223'' across the direction of movement of the conveyor belts 213 guided thereover. Both sections 223' and 223'' are pivotably connected with each other by a folding axis 230. The folding axis 230 in this third exemplary embodiment also serves as a pivot axis for the section 223' and is therefore mounted in a stationary position in the machine frame. One can, however, arrange the position of the folding axis 230 in a height-adjustable manner in the machine frame and provide hoisting devices for this purpose as in the second exemplary embodiment according to FIG. 4. The effect achieved with a height adjustment of the folding axis 230 is the same as that in the second exemplary embodiment according to FIG. 4.

The section 223'' is pivotably supported at one end on the folding axis 230 and is also pivotably supported in the area of its free end at the axis of the roller 215 which corresponds to the roller 15 of the first exemplary embodiment.

The section 223' has an extension passing beyond the folding axis 230, which lies below the section 223''. This type of extension, not being an extension of the other section, could come into use also in the first exemplary embodiment according to FIGS. 1–3 if a differently embodied pivot mechanism were to be provided for the pivoting of the sections 23' and 23'' of the support 23 relative to each other. A lever 238 is hinged to the extension of the section 223' with an axis parallel to the folding axis 230. This lever 238 is hinged on the other end to a horizontally shiftable sled 239. If the sled 239 is moved to the left as seen in FIG. 5, with the aid of a drive motor (not shown), then the section 223' of the support 223 is pivoted clockwise about the folding axis 230, without the section 223" changing its angle of inclination. The drive of the sled 239 is controlled by a control switch 236 and a feeler rod 235 associated therewith, which, like the control switch 136 and the feeler rod 135 next to the suction wheel 119, are arranged above the top sheet.

Initially, the section 223' is set at the same angle of inclination as the section 223", i.e., at the angle formed by the imbricated end of the stack. If the stack thickness begins to decrease, then as is shown in FIG. 2, a bend begins to form on the topside of the stack which results in a shifting of the top sheet upward toward the suction wheel 19. Control switch 236 reacts to this shifting and causes a movement of the sled 239 to the right as seen in FIG. 5. In this manner, the section 223" of the support 223 is pivoted counterclockwise, whereby the two sections 223' and 223" arrive at a position in which they define an upwardly open, obtuse angle. By means of this transition from the fully extended position into the position forming a bend, the bend in the upperside of the stack is eliminated. The top sheet can then continue to be drawn off without difficulty by the suction wheel 219 or by other individualization means.

I claim:

1. A circular stack sheet feeding device, including:

a loading platform, which can be loaded with an imbricated sheet stack, a means for delivering and diverting the imbricated sheet stack from the loading platform, a means for reversing the direction of delivering the imbricated sheet stack onto a removal platform, a conveyor means for delivering the imbricated sheet stack to the removal platform, and individualization means for removing the top sheet of the imbricated sheet stack from the conveyor means, comprising:

a support, divided into two sections which are pivotable relative to each other about a folding axis, said folding axis lying transverse to the direction of movement of the conveyor means, and said two sections being set in pivotable positions, in which the angle defined between the two sections is 180° or an upwardly open obtuse angle, whereby a bend is not formed across the upper side of the top sheet of the imbricated sheet stack so that the top sheet of the imbricated sheet stack will thereby be reliably taken hold of by the individualization means.

2. Circular stack sheet feeding device according to claim 1, characterized in that the folding axis lies below the individualization means.

3. Circular stack sheet feeding device according to claim 1 further comprising:

a sensor means, arranged above the removal platform, for monitoring the level of the top sheet of the imbricated stack with regard to the individualization means.

4. Circular stack sheet feeding device according to claim 3, further comprising:

a pivot drive means, arranged on one of the two sections, for pivoting the other one of the two sections of the support.

5. Circular stack sheet feeding device according to claim 4, characterized in that the sensor means is formed as a control switch for the pivot drive means.

6. Circular stack sheet feeding device according to claim 3, further comprising:

a means for adjusting the height of the imbricated sheet stacks, said height adjusting means being associated with the folding axis.

7. Circular stack sheet feeding device according to claim 6, characterized in that the sensor means is formed as a control switch for the height adjusting means.

8. Circular stack sheet feeding device according to claim 3, characterized in that the sensor means is formed as a control switch means for driving a means for pivoting the two sections of the support relative to each other about the folding axis.

9. Circular stack sheet feeding device according to claim 1, characterized in that one of the two sections farther removed from the reversing means is supported in the area of its free end and is freely pivotably connected with the other of the two sections by means of the folding axis.

10. Circular stack sheet feeding device according to claim 9, characterized in that the folding axis is formed as a pivot axis for the support and further in that a pivot mechanism is associated with one of the two sections of the support.

11. Circular stack sheet feeding device according to claim 10, characterized in that the one of the two sections can be pivoted away by the pivot mechanism and has an extension extending beyond the folding axis and further in that the pivot mechanism engages the one of the two sections for pivotable movement in the area of the extension.

* * * * *